US010697118B2

(12) United States Patent
Mikami et al.

(10) Patent No.: US 10,697,118 B2
(45) Date of Patent: Jun. 30, 2020

(54) METHOD FOR PRODUCING SHEET CONTAINING FINE FIBERS

(71) Applicant: OJI HOLDINGS CORPORATION, Tokyo (JP)

(72) Inventors: Eiichi Mikami, Tokyo (JP); Mitsuru Tsunoda, Tokyo (JP); Hayato Fushimi, Tokyo (JP)

(73) Assignee: OJI HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 14/895,359

(22) PCT Filed: May 21, 2014

(86) PCT No.: PCT/JP2014/063436

§ 371 (c)(1),
(2) Date: Dec. 2, 2015

(87) PCT Pub. No.: WO2014/196357

PCT Pub. Date: Dec. 11, 2014

(65) Prior Publication Data

US 2016/0130757 A1 May 12, 2016

(30) Foreign Application Priority Data

Jun. 3, 2013 (JP) ..... 2013-116947
Aug. 27, 2013 (JP) ..... 2013-175181

(51) Int. Cl.
*D21F 5/00* (2006.01)
*D21H 11/18* (2006.01)
(Continued)

(52) U.S. Cl.
CPC ..... *D21F 5/002* (2013.01); *D21F 5/04* (2013.01); *D21F 5/048* (2013.01); *D21F 5/14* (2013.01); *D21H 11/18* (2013.01); *D21H 19/00* (2013.01)

(58) Field of Classification Search
CPC ..... D21H 11/18; D21H 19/00; D21H 19/10; D21F 5/002; D21F 5/04; D21F 5/048; D21F 5/14
See application file for complete search history.

(56) References Cited

U.S. PATENT DOCUMENTS 5,685,909 A 11/1997 Reich et al.
7,842,162 B1 * 11/2010 Lvov ..... D21H 17/20 162/158

(Continued)

FOREIGN PATENT DOCUMENTS

DE 4414949 A1 * 11/1995 ..... B05C 3/18
DE 19704858 A1 * 8/1998 ..... D21H 23/72

(Continued)

OTHER PUBLICATIONS

Machine Translation of WO 2011/010609 A1, Published on Jan. 27, 2011.*

(Continued)

*Primary Examiner* — Jose A Fortuna
(74) *Attorney, Agent, or Firm* — Birch, Stewart, Kolasch & Birch, LLP

(57) ABSTRACT

The present invention was accomplished in order to provide a method for producing a sheet containing fine fibers, which enables production of a sheet containing fine fibers without producing wrinkles. The present invention provides a method for producing a sheet containing fine fibers comprising a coating step of coating a dispersion containing fine fibers having a fiber diameter of 1000 nm or smaller on a base material, and a drying step of drying the dispersion containing fine fibers coated on the base material to form a sheet containing fine fibers.

12 Claims, 1 Drawing Sheet

(51) Int. Cl.

| | |
|---|---|
| ***D21H 19/00*** | (2006.01) |
| ***D21F 5/04*** | (2006.01) |
| ***D21F 5/14*** | (2006.01) |

(56) References Cited

U.S. PATENT DOCUMENTS

| | | | | |
|---|---|---|---|---|
| 8,377,563 | B2 * | 2/2013 | Miyawaki | C08B 15/02 427/324 |
| 8,585,866 | B2 * | 11/2013 | Mikami | D21F 1/0063 162/202 |
| 8,663,425 | B2 * | 3/2014 | Noishiki | D21H 11/18 156/307.1 |
| 8,845,862 | B2 * | 9/2014 | Shirao | D21F 9/00 162/289 |
| 9,718,980 | B2 * | 8/2017 | F. Chin | C09D 101/02 |
| 10,323,354 | B2 * | 6/2019 | Kawahara | B01D 71/80 |
| 2002/0060009 | A1 * | 5/2002 | Wulz | D21H 23/72 162/135 |
| 2004/0223040 | A1 * | 11/2004 | Graham | B41M 5/52 347/105 |
| 2005/0011624 | A1 * | 1/2005 | Korhonen | D21F 3/045 162/205 |
| 2005/0089641 | A1 * | 4/2005 | Fors | D21H 19/82 427/365 |
| 2006/0266485 | A1 * | 11/2006 | Knox | B32B 29/02 162/135 |
| 2007/0148365 | A1 * | 6/2007 | Knox | D01D 5/0084 427/462 |
| 2007/0235152 | A1 * | 10/2007 | Nakazawa | D21H 23/74 162/192 |
| 2008/0149561 | A1 * | 6/2008 | Chu | A61L 15/425 210/500.38 |
| 2009/0305033 | A1 * | 12/2009 | Yano | D21H 21/26 428/339 |
| 2010/0175846 | A1 * | 7/2010 | Begemann | D21F 5/18 162/265 |
| 2010/0233481 | A1 | 9/2010 | Isogai et al. | |
| 2011/0008638 | A1 * | 1/2011 | Miyawaki | C08B 15/02 428/537.5 |
| 2013/0005869 | A1 | 1/2013 | Yano et al. | |
| 2013/0022827 | A1 * | 1/2013 | Imai | B32B 27/12 428/446 |
| 2013/0078882 | A1 | 3/2013 | Yoo et al. | |
| 2013/0112361 | A1 * | 5/2013 | Mikami | D21F 1/0063 162/202 |
| 2013/0157021 | A1 * | 6/2013 | Baumlin | B41M 5/52 428/207 |
| 2013/0269898 | A1 * | 10/2013 | Shirao | D21F 9/00 162/375 |
| 2014/0050922 | A1 * | 2/2014 | F. Chin | C09D 101/02 428/372 |
| 2014/0315009 | A1 * | 10/2014 | Noda | C08L 79/02 428/220 |
| 2015/0330025 | A1 * | 11/2015 | Luna Marroquin | D21H 17/11 162/158 |
| 2015/0368441 | A1 * | 12/2015 | Retsina | C08L 1/02 442/59 |
| 2016/0130757 | A1 * | 5/2016 | Mikami | D21F 5/048 162/207 |
| 2016/0177512 | A1 * | 6/2016 | Kawahara | D21H 19/24 435/289.1 |
| 2017/0183820 | A1 * | 6/2017 | Banzashi | H05B 33/02 |
| 2017/0226407 | A1 * | 8/2017 | Homma | C09K 8/10 |
| 2018/0264788 | A1 * | 9/2018 | Sunagawa | B32B 27/365 |
| 2018/0371696 | A1 * | 12/2018 | Sunagawa | B32B 23/02 |
| 2019/0055697 | A1 * | 2/2019 | Sakai | C08L 1/00 |

FOREIGN PATENT DOCUMENTS

| | | | | |
|---|---|---|---|---|
| EP | 2216345 | A1 | 8/2010 | |
| EP | 3006622 | A4 * | 1/2017 | D21F 5/048 |
| JP | H08-512368 | A | 12/1996 | |
| JP | 10-212683 | A | 8/1998 | |
| JP | 10212683 | A * | 8/1998 | |
| JP | 2001-159090 | A | 6/2001 | |
| JP | 2001159090 | A * | 6/2001 | D21H 23/72 |
| JP | 2005-89950 | A | 4/2005 | |
| JP | 2005-538863 | A | 12/2005 | |
| JP | 2007-23218 | A | 2/2007 | |
| JP | 2007-23219 | A | 2/2007 | |
| JP | 2008-248441 | A | 10/2008 | |
| JP | 2010-115574 | A | 5/2010 | |
| JP | 2010115574 | A * | 5/2010 | B01D 39/16 |
| JP | 2010-254726 | A | 11/2010 | |
| JP | 2010-270315 | A | 12/2010 | |
| JP | 2011-42903 | A | 3/2011 | |
| JP | 2011-73174 | A | 4/2011 | |
| JP | 2011-162608 | A | 8/2011 | |
| JP | 2011-173993 | A | 9/2011 | |
| JP | WO 2012011559 | A1 * | 1/2012 | D21F 1/0063 |
| JP | 2012057285 | A * | 3/2012 | |
| JP | WO 2012043103 | A1 * | 4/2012 | D21H 11/18 |
| JP | 2012-116905 | A | 6/2012 | |
| JP | 2012-117183 | A | 6/2012 | |
| JP | 2012-516399 | A | 7/2012 | |
| JP | 2012132103 | A * | 7/2012 | D21F 9/00 |
| JP | WO 2012090908 | A1 * | 7/2012 | C08J 5/24 |
| JP | 2012-149355 | A | 8/2012 | |
| JP | 2012149355 | A * | 8/2012 | |
| JP | 2013-71456 | A | 4/2013 | |
| JP | 2013-82796 | A | 5/2013 | |
| JP | 2013096026 | A * | 5/2013 | B01D 61/56 |
| JP | 2013096026 | A * | 5/2013 | |
| JP | 2013-136859 | A | 7/2013 | |
| JP | 2014-84431 | A | 5/2014 | |
| JP | 2014084431 | A * | 5/2014 | |
| JP | 2014163028 | A * | 9/2014 | |
| JP | 2014181270 | A * | 9/2014 | |
| JP | 2014198928 | A * | 10/2014 | |
| JP | WO 2014196357 | A1 * | 12/2014 | D21F 5/048 |
| JP | 5690387 | B2 * | 3/2015 | B05D 5/08 |
| JP | 2015127467 | A * | 7/2015 | |
| JP | WO 2015182438 | A1 * | 12/2015 | B32B 5/28 |
| JP | WO 2016060120 | A1 * | 4/2016 | C09K 8/10 |
| WO | WO-02103109 | A1 * | 12/2002 | D21F 3/045 |
| WO | WO-03056102 | A1 * | 7/2003 | D21H 19/82 |
| WO | WO 2004/016852 | A2 | 2/2004 | |
| WO | WO 2004/016852 | A3 | 2/2004 | |
| WO | WO-2005052252 | A1 * | 6/2005 | D21F 5/18 |
| WO | WO 2007/091942 | A1 | 8/2007 | |
| WO | WO-2007088974 | A1 * | 8/2007 | B05D 5/08 |
| WO | WO 2007088974 | A1 * | 8/2007 | B05D 5/08 |
| WO | WO 2009/069641 | A1 | 6/2009 | |
| WO | WO 2010/033960 | A1 | 3/2010 | |
| WO | WO 2010/088403 | A2 | 8/2010 | |
| WO | WO 2011/010609 | A1 | 1/2011 | |
| WO | WO-2011010609 | A1 * | 1/2011 | D21F 9/02 |
| WO | WO 2011/151525 | A1 | 12/2011 | |
| WO | WO 2012/156880 | A1 | 11/2012 | |
| WO | WO-2012156880 | A1 * | 11/2012 | B01D 61/56 |
| WO | WO 2013/073652 | A1 | 5/2013 | |
| WO | WO 2013/094563 | A1 | 6/2013 | |
| WO | WO-2016060120 | A1 * | 4/2016 | C09K 8/10 |

OTHER PUBLICATIONS

Machine Translation of JP 2007023218 A (Year: 2007).*

Machine Translation of JP 2012117183 A (Year: 2012).*

Machine Translation of WO 2011/010609 A1 (Year: 2011).*

Fukui, "Experimental Methods of Biochemistry (Quantification Method of Reducing Sugar)," 2nd Ed., Japan Scientific Societies Press, 1990, pp. 23-24 (Total 9 pages), along with an English translation.

International Preliminary Report on Patentability and Written Opinion of the International Searching Authority (forms PCT/IB/373, PCT/ISA/237, PCT/IB/338 and PCT/IB/326), dated Dec. 17, 2015, for International Application No. PCT/JP2014/063436, with an English translation of the Written Opinion.

International Search Report (form PCT/ISA/210), dated Aug. 26, 2014, for International Application No. PCT/2014/063436.

(56) References Cited

OTHER PUBLICATIONS

Japanese Office Action dated Jun. 7, 2016 issued in corresponding Japanese Patent Application No. 2015-521376.
Japanese Decision of Refusal for corresponding Japanese Application No. 2015-521376, dated Nov. 22, 2016, with an English translation.
Chinese Office Action dated Dec. 28, 2016, issued in corresponding Chinese Patent Application No. 201480031869.0.
Extended European Search Report dated Dec. 12, 2016, issued in corresponding European Patent Application No. 14807424.8.
Japanese Notification of Reasons for Refusal for corresponding Japanese Application No. 2017-028903, dated Feb. 27, 2018, with Machine translation.
Chinese Second Office Action dated Oct. 27, 2017, for corresponding Chinese Application No. 201480031869.0, with English machine translation.
Japanese Office Action dated Nov. 27, 2018 for corresponding Japanese Patent Application No. 2017-028903, with English translation.
Decision on Refusal dated Aug. 20, 2019 issued in corresponding Japanese patent application No. 2017-028903 with its English Translation.
Korean Office Action dated Mar. 28, 2020, issued in corresponding Republic of Korea Patent Application No. 10-2015-7035404, with English Machine Translation.

* cited by examiner

[Fig. 1]
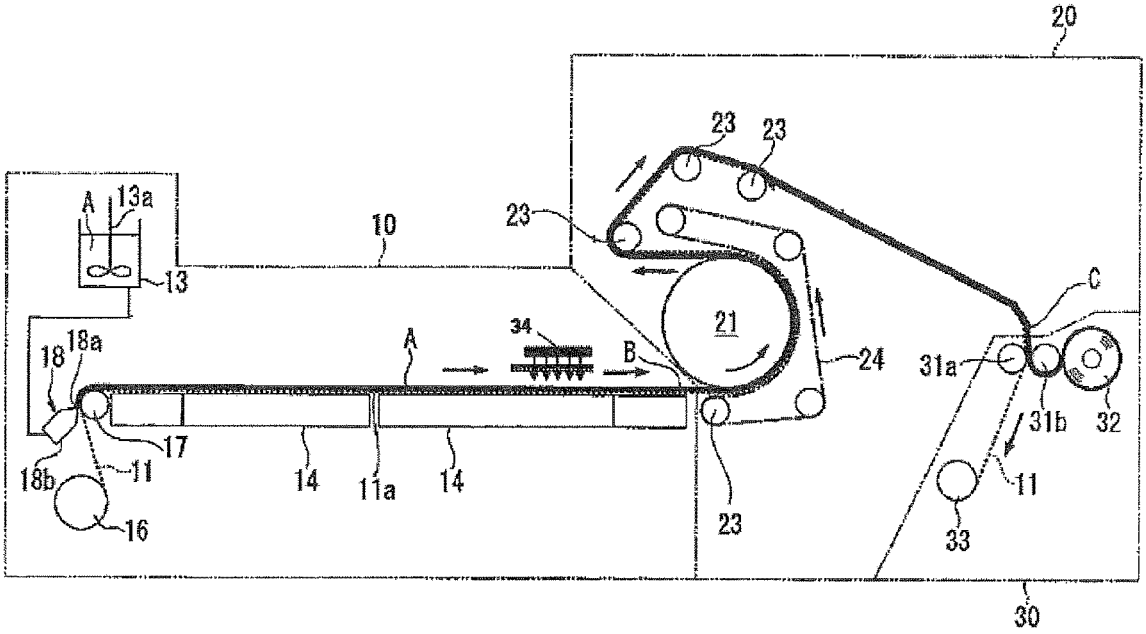
[Fig. 2]
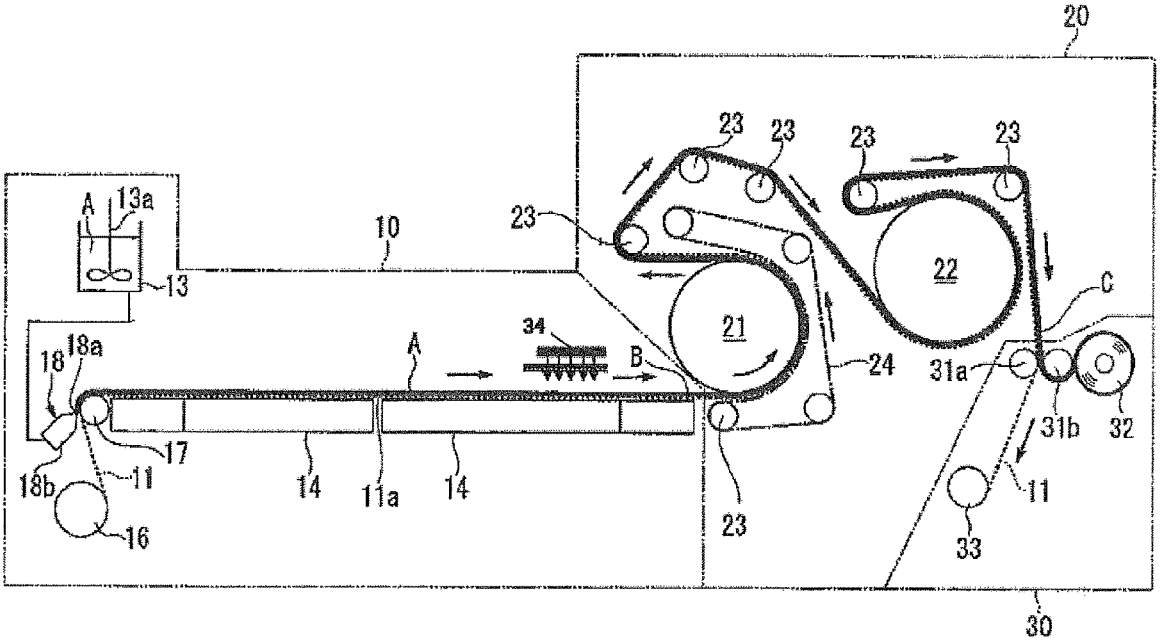

METHOD FOR PRODUCING SHEET CONTAINING FINE FIBERS

TECHNICAL FIELD

The present invention relates to a method for producing a sheet containing fine fibers. More precisely, the present invention relates to a method for producing a fine fiber sheet comprising a specific drying process, and a method for producing a sheet containing fine fibers using a hydrophilic polymer.

BACKGROUND ART

In recent years, as an alternative to oil resources and in connection with the growing environmental consciousness, applications of reproducible natural fibers attract attentions. Among natural fibers, cellulose fibers, especially those derived from wood (pulp), are widely used mainly for paper products. Most of cellulose fibers used for paper products have a fiber width of 10 to 50 μm. Paper (sheet) obtained from such cellulose fibers is opaque, and is widely used as paper for printing. If cellulose fibers are refined (microfibrillated) by a treatment in a refiner, kneader, sand grinder, or the like (beating or grinding), transparent papers (glassine paper etc.) are obtained from such fibers.

As an apparatus for producing a sheet containing fibers, Patent document 1 (Japanese Patent Unexamined Publication (KOHYO) No. 2012-516399) discloses an apparatus for making a nonwoven web, the apparatus comprising: a) a first source configured to dispense a first fluid flow stream comprising a fiber; b) a second source configured to dispense a second fluid flow stream also comprising a fiber; c) a mixing partition downstream from the first and second sources, the mixing partition positioned between the first and second flow streams, the mixing partition defining two or more openings in the mixing partition that permit fluid communication and mixing between the first and second flow streams; and d) a receiving region situated downstream from the first and second sources and designed to receive at least a combined flow stream and form a nonwoven web by collecting the combined flow stream, and Japanese Patent Unexamined Publication (KOHYO) No. 2012-516399 Patent document 1 describes that the apparatus may further comprise a drying section proximal and downstream to the receiving region, and the drying section may comprise a drying can section, one or more IR heaters, one or more UV heaters, a through-air dryer, a transfer wire, a conveyor, or a combination thereof.

Patent document 2 (Japanese Patent Unexamined Publication (KOKAI) No. 2012-116905) discloses a method for producing a composite porous sheet using fine cellulose fibers and a polymer having a film-forming property, which is a method for producing a fine cellulose fiber composite porous sheet comprising a preparation step of mixing an aqueous suspension containing the fine cellulose fibers with an emulsion of the polymer having a film-forming property to produce a mixture, a papermaking step of forming a sheet containing moisture by dehydrating the mixture by filtration on a porous base material, a step of substituting an organic solvent for the moisture contained in the sheet, and a drying step of drying the organic solvent-substituted sheet by heating, and mentions cylinder dryer, yankee dryer, hot air drying, infrared heater, etc. as the drying means.

Patent document 2 discloses a method for producing a composite porous sheet using fine cellulose fibers and a polymer having a film-forming property, which is a method for producing a fine cellulose fiber composite porous sheet comprising a preparation step of mixing an aqueous suspension containing the fine cellulose fibers with an emulsion of the polymer having a film-forming property to produce a mixture, a papermaking step of forming a sheet containing moisture by dehydrating the mixture by filtration on a porous base material, a step of substituting an organic solvent for the moisture contained in the sheet, and a drying step of drying the organic solvent-substituted sheet by heating, and mentions cylinder dryer, yankee dryer, hot air drying, infrared heater, etc. as the drying means.

Patent documents 3 and 4 (Japanese Patent Unexamined Publication (KOKAI) No. 2007-23218 and Japanese Patent Unexamined Publication (KOKAI) No. 2007-23219) describe a fine fiber sheet obtained by separating a dry fine fiber layer from a base material, which dry fine fiber layer is formed on the base material by applying a slurry containing fine fibers on the base material and evaporating liquid components in the slurry, and describe that hot air drying, infrared drying, vacuum drying etc. are effective for the drying.

Patent document 5 (Japanese Patent Unexamined Publication (KOKAI) No. 2008-248441) describes a fiber sheet containing cellulose fine fibers treated with a hydrophobizing agent such as a sizing agent, oil and fat, wax, and hydrophobic resin. The fiber sheet described in Patent document 5 Japanese Patent Unexamined Publication (KOKAI) No. 2008-248441 shows low hygroscopicity and thus reduced dimensional change due to moisture absorption, because it is constituted with cellulose fine fibers made hydrophobic.

Patent document 6 (Japanese Patent Unexamined Publication (KOKAI) No. 2013-71456) describes a porous sheet comprising a fine fiber web layer consisting of fine fibers having a diameter of 50 to 5000 nm, and a support layer, on one or both surfaces of which the fine fiber web layer is bonded. Further, it describes that the fine fiber web layer is formed by forming fine fibers consisting of a mixture of a polymer and an adhesive material through electrostatic spinning of a spinning solution consisting of a mixture of solutions of the polymer and the adhesive material, spraying a solution of the adhesive material on the fine fibers, and then bonding the fibers on the support layer to form the fine fiber web layer.

PRIOR ART REFERENCES

Patent Documents

Patent document 1: Japanese Patent Unexamined Publication (KOHYO) No. 2012-516399

Patent document 2: Japanese Patent Unexamined Publication (KOKAI) No. 2012-116905

Patent document 3: Japanese Patent Unexamined Publication (KOKAI) No. 2007-23218

Patent document 4: Japanese Patent Unexamined Publication (KOKAI) No. 2007-23219

Patent document 5: Japanese Patent Unexamined Publication (KOKAI) No. 2008-248441

Patent document 6: Japanese Patent Unexamined Publication (KOKAI) No. 2013-71456

DISCLOSURE OF THE INVENTION

Object to be Achieved by the Invention

An object of the present invention is to provide a method for producing a sheet containing fine fibers, which enables production of a sheet containing fine fibers without forming wrinkles.

Means for Achieving the Object

The inventors of the present invention conducted various researches in order to achieve the aforementioned object, and as a result, found that a sheet containing fine fibers could be produced without forming wrinkles by a coating step of coating a dispersion containing fine fibers having a fiber diameter of 1000 nm or smaller on a base material, and a drying step of drying the dispersion containing the fine fibers coated on the base material to form a sheet containing fine fibers. One aspect of the present invention was accomplished on the basis of the above finding.

The present invention is thus embodied as follows.

(1) A method for producing a sheet containing fine fibers, which comprises a coating step of coating a dispersion containing fine fibers having a fiber diameter of 1000 nm or smaller on a base material, and a drying step of drying the dispersion containing fine fibers coated on the base material to form a sheet containing fine fibers.

(2) The method for producing a sheet containing fine fibers according to (1), wherein the drying step includes at least two stages.

(3) The method for producing a sheet containing fine fibers according to (1) or (2), wherein the drying step includes a first non-contact drying step and a subsequent second drying step in which the sheet is dried in a restrained state.

(4) The method for producing a sheet containing fine fibers according to (3), wherein the first non-contact drying step is performed by using one or more selected from an infrared radiation apparatus, a far-infrared radiation apparatus, and a near-infrared radiation apparatus.

(5) The method for producing a sheet containing fine fibers according to (3) or (4), wherein, after the first non-contact drying step, the sheet has a solid content concentration ($\rho_2$) of 3 to 21 mass %.

(6) The method for producing a sheet containing fine fibers according to any one of (3) to (5), wherein $\alpha_{21}$ represented by the following equation (1) and calculated from solid content concentration ($\rho_1$) of the sheet observed before the first non-contact drying step, solid content concentration ($\rho_2$) of the sheet observed after the first non-contact drying step, and time $t_{21}$ (minute) required for the solid content concentration to become $\rho_2$ from $\rho_1$ is 0.01 to 1.0 (%/minute).

$$\alpha_{21}=(\rho_2-\rho_1)/t_{21} \quad \text{Equation (1):}$$

(7) The method for producing a sheet containing fine fibers according to any one of (1) to (6), wherein the solid content concentration ($\rho_a$) of the sheet observed after the drying step is 88 to 99 mass %.

(8) The method for producing a sheet containing fine fibers according to any one of (3) to (7), wherein $\alpha_{43}$ represented by the following equation (2) and calculated from solid content concentration ($\rho_3$) of the sheet observed before the second drying step where the sheet is dried in a restrained state, solid content concentration ($\rho_a$) of the sheet observed after the second drying step, and time $t_{43}$ (minute) required for the solid content concentration to become $\rho_3$ from $\rho_4$ is 0.01 to 30.0 (%/minute).

$$\alpha_{43}=(\rho_4-\rho_3)/t_{43} \quad \text{Equation (2):}$$

(9) The method for producing a sheet containing fine fibers according to any one of (1) to (8), which comprises the step of filtering the dispersion containing fine fibers with a papermaking wire, which is performed before or during the drying step of drying the dispersion containing fine fibers coated on the base material to form the sheet containing fine fibers.

(10) The method for producing a sheet containing fine fibers according to any one of (1) to (9), wherein the sheet containing fine fibers is a continuous sheet.

(11) The method for producing a sheet containing fine fibers according to any one of (1) to (10), wherein the fine fibers has a fiber diameter of 100 nm or smaller.

The inventors of the present invention also successfully produced a sheet containing fine fibers without producing wrinkles by coating a suspension on a base material, and drying the suspension, wherein the suspension contains fine fibers which is obtained by subjecting a fiber raw material to a chemical treatment and a fibrillation treatment and has an average fiber width of 2 to 100 nm, and a hydrophilic polymer. Another aspect of the present invention was accomplished on the basis of this finding.

The present invention is thus also embodied as follows.

(1) A method for producing a sheet containing fine fibers, which comprises a coating step of coating a suspension on a base material, and drying the coated suspension, wherein the suspension contains fine fibers which is obtained by subjecting a fiber raw material to a chemical treatment and a fibrillation treatment and has an average fiber width of 2 to 100 nm, and a hydrophilic polymer.

(2) The method for producing a sheet containing fine fibers according to (1), wherein 5 to 200 mass parts of the hydrophilic polymer is added with respect to 100 mass parts of solid content of the fine fibers.

(3) The method for producing a sheet containing fine fibers according to (1) or (2), wherein the hydrophilic polymer has a molecular weight of $1.0\times10^3$ to $1.0\times10^7$.

(4) The method for producing a sheet containing fine fibers according to any one of (1) to (3), wherein $\alpha_{21}$ represented by the following equation (1) and calculated from solid content concentration ($\rho_1$) of the sheet observed before the drying step, solid content concentration ($\rho_2$) of the sheet observed after the drying step, and time $t_{21}$ (minute) required for the solid content concentration to become $\rho_2$ from $\rho_1$ is 0.01 to 30.0 (%/minute).

$$\alpha_{21}=(\rho_2-\rho_1)/t_{21} \quad \text{Equation (1):}$$

(5) The method for producing a sheet containing fine fibers according to any one of (1) to (4), wherein the fiber raw material is a lignocellulose raw material.

(6) The method for producing a sheet containing fine fibers according to any one of (1) to (5), wherein the fine fibers are fine fibers obtained by the step of treating a lignocellulose raw material with at least one kind of compound selected from an oxo acid, a polyoxo acid, and a salt thereof, which contain a phosphorus atom in the structures thereof, and a fibrillation treatment of the lignocellulose raw material obtained after the foregoing treatment step.

(7) The method for producing a sheet containing fine fibers according to any one of (1) to (6), wherein the fine fibers have an average fiber width not smaller than 2 nm and not larger than 10 nm.

Effect of the Invention

According to the present invention, a sheet containing fine fibers can be produced without producing wrinkles.

BRIEF DESCRIPTION OF THE DRAWINGS

FIG. 1 shows the apparatus for producing a continuous sheet containing fine fibers used in the examples.

FIG. 2 shows another example of the apparatus for producing a continuous sheet containing fine fibers.

DESCRIPTION OF NOTATIONS

10: First drying section
11: Papermaking wire
11*a*: Horizontal part
13: Supply tank
13*a*: Stirrer
14: Suction means
16: Feeding reel
17: Guide roll
18: Die coater
18*a*: Hole
18*b*: Head
20: Second drying section
21: First dryer
22: Second dryer
23: Guide roll
24: Felt cloth
30: Rolling-up section
31*a* and 31*b*: Separation roller
32: Rolling-up reel
33: Recovery reel
34: Infrared radiation apparatus
A: Fine fiber dispersion
B: Moisture-containing web
C: Sheet containing fine fibers

MODES FOR CARRYING OUT THE INVENTION

Hereafter, the present invention will be explained in more detail.

<Fine Fibers>

Type of the fine fibers used in one aspect of the present invention is not particularly limited so long as they are fine fibers having a fiber diameter of 1000 nm or smaller, and they may be, for example, fine cellulose fibers, or fine fibers other than fine cellulose fibers, or may be a mixture of fine cellulose fibers and fine fibers other than fine cellulose fibers.

Type of the fine fibers used in the other aspect of the present invention is not particularly limited so long as they are fine fibers having an average fiber width of 2 to 100 nm. They may be, for example, fine cellulose fibers, or fine fibers other than fine cellulose fibers, or may be a mixture of fine cellulose fibers and fine fibers other than fine cellulose fibers.

Details of fine cellulose fibers will be described later. Examples of fibers other than fine cellulose fibers include, for example, inorganic fibers, organic fibers, synthetic fibers, semisynthetic fibers, and regenerated fiber, but they are not particularly limited. Examples of the inorganic fibers include, for example, glass fibers, rock fibers, metal fibers, and so forth, but are not limited to these. Examples of the organic fibers include, for example, carbon fibers, fibers derived from natural products such as chitin and chitosan, and so forth, but are not limited to these. Examples of the synthetic fibers include, for example, fibers of nylon, vinylon, vinylidene, polyester, polyolefin (e.g., polyethylene, polypropylene etc.), polyurethane, acrylic resin, polyvinyl chloride, aramid, and so forth, but are not limited to these. Examples of the semisynthetic fibers include, for example, fibers of cellulose acetate, cellulose triacetate, promix, and so forth, but are not limited to these. Examples of the regenerated fiber include, for example, fibers of rayon, cupra, polynosic rayon, lyocell, tencel, and so forth, but are not limited to these. When a mixture of fine cellulose fibers and fine fibers other than fine cellulose fibers is used, the fine fibers other than fine cellulose fibers can be subjected to such a treatment as chemical treatment and fibrillation treatment, as required. When fine fibers other than fine cellulose fibers are subjected to such a treatment as chemical treatment and fibrillation treatment, the fibers other than fine cellulose fibers may be mixed with fine cellulose fibers, and then subjected to such a treatment as chemical treatment and fibrillation treatment, or the fibers other than fine cellulose fibers may be subjected to such a treatment as chemical treatment and fibrillation treatment, and then mixed with fine cellulose fibers. When fine fibers other than fine cellulose fibers are mixed, addition amount of the fine fibers other than the fine cellulose fiber relative to the total amount of the fine cellulose fibers and the fine fibers other than fine cellulose fibers is not particularly limited. The addition amount is preferably 50 mass % or smaller, more preferably 40 mass % or smaller, still more preferably 30 mass % or smaller. The addition amount is particularly preferably 20 mass % or smaller.

<Fine Cellulose Fiber>

In the present invention, fine cellulose fibers obtained by subjecting a cellulose raw material, which includes a lignocellulose raw material, to a chemical treatment and a fibrillation treatment may be used.

Examples of the cellulose raw material include pulp for papermaking, cotton-based pulp such as those derived from cotton linters and cotton lint, non-wood-based pulp such as those derived from hemp, straw, or bagasse, cellulose isolated from sea squirts or seaweeds, and so forth, but it is not particularly limited. Among these, pulp for papermaking is preferred in view of availability, but the cellulose raw material is not particularly limited. Examples of pulp for papermaking include chemical pulp such as broadleaf tree kraft pulp (leaf bleached kraft pulp (LBKP), leaf unbleached kraft pulp (LUKP), leaf oxygen-bleached kraft pulp (LOKP) etc.), conifer kraft pulp (needle bleached kraft pulp (NBKP), needle unbleached kraft pulp (NUKP), needle oxygen-bleached kraft pulp (NOKP) etc.), sulfite pulp (SP), and soda pulp (AP); semi-chemical pulp such as so-called semi-chemical pulp (SCP) and chemiground wood pulp (CGP); mechanical pulp such as ground wood pulp (GP) and thermomechanical pulp (TMP, BCTMP), non-wood-based pulp derived from paper mulberry, paper birch, hemp, kenaf, etc. as a raw material, and deinking pulp derived from used paper as a raw material, but the pulp for papermaking is not particularly limited. Among these, kraft pulp, deinking pulp, and sulphite pulp are preferred in view of higher availability, but it is not particularly limited. One kind of cellulose raw material may be independently used, or two or more kinds of cellulose raw materials may be used as a mixture.

Although average fiber width of the fine cellulose fibers is not particularly limited, the fine cellulose fibers are those having an average fiber width of preferably 2 to 1000 nm, more preferably 2 to 100 nm, still more preferably 2 to 50 nm. The fine cellulose fibers may be cellulose fibers or rod-like particles far thinner than pulp fibers usually used for papermaking. The fine cellulose fibers consist of aggregates of cellulose molecules containing crystal moieties, and have the I-form crystal structure (parallel chain). The average fiber width of the fine cellulose fibers is preferably 2 to 1000 nm, more preferably 2 to 100 nm, still more preferably 2 to 50 nm, particularly preferably not smaller than 2 nm and smaller than 10 nm, as determined by electron microscopy, but it is not particularly limited. If the average fiber width of the fine cellulose fibers is smaller than 2 nm, they are dissolved in water as cellulose molecules, and therefore they no longer exhibit physical properties as fine cellulose fibers (strength, rigidity, and dimensional stability). It can be determined that the fine cellulose fibers have the I-form crystal structure on the basis of a diffraction profile thereof obtained from a wide angle X-ray diffraction photograph taken by using CuKα (λ=1.5418 Å) monochromatized with graphite. Specifically, it can be determined on the basis of typical peaks at two positions around 2θ=14 to 17° and 2θ=22 to 23°. The fiber width of the fine cellulose fibers is measured by electron microscopy as follows. An aqueous suspension of the fine cellulose fibers at a concentration of 0.05 to 0.1 mass % is prepared, and the suspension is cast on a hydrophilized carbon film-coated grid to prepare a sample for TEM observation. When fibers having a large width are contained, an SEM image of a surface of the suspension cast on glass may be observed. The observation based on an electron microscope image is performed at a magnification of 1000 times, 5000 times, 10000 times, or 50000 times, depending on the width of the constituent fibers. The sample, observation conditions, and magnification are adjusted so that the following requirements are satisfied.

(1) With a straight line X drawn at an arbitrary position on an observation image, 20 or more fibers intersect.

(2) With a straight line Y drawn on the same image so as to perpendicularly intersect with the straight line X, 20 or more fibers intersect.

On an observation image satisfying the aforementioned requirements, widths of the fibers intersecting with the straight lines X and Y are visually read. In this way, at least three of images of surface portions not overlapping are observed, and widths of fibers intersecting with the straight lines X and Y are read on each image. As described above, widths of at least 20×2×3=120 of fibers are read. The average fiber width of the fine cellulose fibers is an average of the fiber widths read as described above.

Although fiber length of the fine cellulose fibers is not particularly limited, it is preferably 1 to 1000 μm, more preferably 5 to 800 μm, particularly preferably 10 to 600 μm. If the fiber length is shorter than 1 μm, it becomes difficult to form a fine fiber sheet. If it exceeds 1000 μm, viscosity of slurry of the fine fibers becomes extremely high, and handling thereof becomes difficult. The fiber length can be determined by TEM, SEM, or AFM image analysis.

The axis ratio of fine cellulose fibers (fiber length/fiber width) is preferably in the range of 100 to 10000. If the axis ratio is smaller than 100, it might become difficult to form a sheet containing fine cellulose fibers. If the axis ratio exceeds 10000, viscosity of the slurry unfavorably increases.

<Chemical Treatment>

The method for the chemical treatment of the cellulose raw material or other fiber raw materials (inorganic fibers, organic fibers, synthetic fibers, semi-synthetic fibers, regenerated fibers, etc.) is not particularly limited so long as a method that can give fine fibers is chosen. Examples include, for example, ozone treatment, TEMPO oxidation treatment, enzyme treatment, treatment with a compound that can form a covalent bond with a functional group in cellulose or the fiber raw material, and so forth, but are is not limited to these.

Examples of the ozone treatment include the method described in Japanese Patent Unexamined Publication (KOKAI) No. 2010-254726, but it is not particularly limited. Specifically, the fibers are subjected to the ozone treatment, and then dispersed in water, and the obtained aqueous dispersion of the fibers is subjected to a grinding treatment.

Examples of the enzyme treatment include the method described in Japanese Patent Application No. 2012-115411 (the entire disclosure of Japanese Patent Application No. 2012-115411 is incorporated into the disclosure of the present description by reference), but it is not particularly limited. Specifically, it is a method of treating a fiber raw material with an enzyme at least under a condition that ratio of the EG activity to the CBHI activity of the enzyme is 0.06 or larger.

The EG activity is measured and defined as follows.

A substrate solution of carboxymethylcellulose (CMCNa High viscosity, Cat. No. 150561, MP Biomedicals, Inc.) at a concentration of 1% (W/V) (containing a 100 mM acetic acid/sodium acetate buffer, pH 5.0) was prepared. An enzyme for measurement was diluted in advance with a buffer (the same as that described above, the dilution rate may be such a rate that the absorbance of the enzyme solution described below is within the range of the calibration curve obtained from glucose standard solutions described below). The enzyme solution (10 μL) obtained by the dilution was added to the substrate solution (90 μL), and the reaction was allowed at 37° C. for 30 minutes.

To create a calibration curve, 100 μL each of ion exchanged water (blank) and glucose standard solutions (at least four standard solutions having different concentrations selected from the concentrations of 0.5 to 5.6 mM) were prepared and incubated at 37° C. for 30 minutes.

A DNS coloring solution (300 μL, 1.6 mass % of NaOH, 1 mass % of 3,5-dinitrosalicylic acid, and 30 mass % of potassium sodium tartrate) was added to each of the enzyme-containing solution obtained after the reaction, the blank, and the glucose standard solutions for the calibration curve, and the mixture was boiled for 5 minutes to develop color. After the color development, the mixture was immediately cooled on ice, and 2 mL of ion exchange water was added, and they were fully mixed. After the mixture was left standing for 30 minutes, absorbance thereof was measured within one hour.

Absorbance was measured at 540 nm for 200 μL of the mixture put into a well of a 96-well Microwell Plate (269620, NUNC) by using a microplate reader (Infinite M200, TECAN).

A calibration curve was created by using values obtained by subtracting the absorbance of the blank from the absorbances of glucose standard solutions, and the glucose concentrations. The produced glucose equivalent amount in the enzyme solution was calculated from a value obtained by subtracting the absorbance of the blank from the absorbance of the enzyme solution by using the calibration curve (if the absorbance of the enzyme solution is not in the range of the calibration curve, another measurement is performed with changing the dilution rate for diluting the enzyme with the buffer). An amount of the enzyme that produces 1 μmol of glucose equivalent of reducing sugar per one minute is defined as 1 unit, and the EG activity is calculated in accordance with the following equation.

EG activity=Produced glucose equivalent in 1 mL of enzyme solution obtained by diluting with buffer (μmol)/30 minutes×Dilution rate (refer to Sakuzo FUKUI, "Experimental Methods of Biochemistry (Quantification Method of Reducing Sugar), 2nd Ed.", Japan Scientific Societies Press, pp. 23-24 (1990)).

The CBHI activity is measured and defined as described below.

In a well of 96-well Microwell Plate (269620, NUNC), 32 μL of 1.25 mM 4-methyl-umberiferyl-cellobioside (dissolved in a 125 mM acetic acid/sodium acetate buffer, pH 5.0) is dispensed, and 4 μL of 100 mM glucono-1,5-lactone is added. Then, 4 μL of the enzyme solution for measurement diluted with the same buffer as mentioned above (dilution rate may be such a rate that fluorescence intensity of the enzyme solution described below is within the range of the calibration curve obtained with the standard solutions described below) is added to the solution, and the reaction is allowed at 37° C. for 30 minutes. Thereafter, 200 μL of a 500 mM glycine/NaOH buffer (pH 10.5) is added to terminate the reaction.

As the standard solutions for preparing the calibration curve, 40 μL each of 4-methyl-umberiferon standard solutions (at least four of standard solutions having different concentrations selected from the concentration range of 0 to 50 μM) are put in wells of the same 96-well Microwell Plate as mentioned above, and warmed at 37° C. for 30 minutes. Then, 200 μL of a 500 mM glycine/NaOH buffer (pH 10.5) is added.

Fluorescence intensity is measured at 350 nm (excitation: 460 nm) by using a microplate reader (Fluoroskan Ascent FL, Thermo-Labsystems). Amount of the produced 4-methyl-umberiferon in the enzyme solution is calculated by using the calibration curve created from the data obtained with the standard solutions (if the fluorescence intensity of the enzyme solution is out of the range of the calibration curve, another measurement is performed with changing the dilution rate). An amount of the enzyme that produces 1 μmol of 4-methyl-umberiferon per one minute is defined as 1 unit, and the CBHI activity is calculated from the following equation.

CBHI activity=Amount of produced 4-methyl-umberiferon in 1 mL of diluted enzyme solution (μmol)/30 minutes×Dilution rate Examples of the treatment with a compound that can form a covalent bond with a functional group in cellulose or a fiber raw material include the following treatments, but it is not particularly limited:

- Treatment with a compound having a quaternary ammonium group, which is described in Japanese Patent Unexamined Publication (KOKAI) No. 2011-162608;
- Method using a carboxylic acid compound, which is described in Japanese Patent Unexamined Publication (KOKAI) No. 2013-136859;
- Method using "at least one kind of compound selected from oxo acids, polyoxo acids and salts thereof containing a phosphorus atom in the structure thereof", which is described in International Patent Publication WO2013/073652 (PCT/JP2012/079743).

The treatment with a compound having a quaternary ammonium group described in Japanese Patent Unexamined Publication (KOKAI) No. 2011-162608 is a method of reacting hydroxyl groups in fibers and a cationizing agent having a quaternary ammonium group to modify the fibers by cationization.

The method described in Japanese Patent Unexamined Publication (KOKAI) No. 2013-136859 uses at least one kind of carboxylic acid compound selected from a compound having two or more carboxy groups, an anhydride of a compound having two or more carboxy groups, and a derivative thereof. This method is a method comprising a carboxy group-introducing step of treating a fiber raw material with these compounds to introduce carboxy groups into the fiber raw material, and an alkali treatment step of treating the carboxy group-introduced fiber raw material with an alkali solution after completion of the carboxy group-introducing step.

International Patent Publication WO2013/073652 (PCT/JP2012/079743) describes a method of treating a fiber raw material with at least one kind of compound selected from oxo acid, polyoxo acid, and salt thereof containing a phosphorus atom in the structure thereof (compound A). Specific examples of this method include a method of mixing powder or aqueous solution of the compound A with a fiber raw material, a method of adding an aqueous solution of the compound A to a slurry of the fiber raw material, and so forth. Examples of the compound A include phosphoric acid, polyphosphoric acid, phosphorous acid, phosphonic acid, polyphosphonic acid, and esters thereof, but it is not particularly limited. These compounds may be in the form of a salt. Examples of the compound having phosphoric acid group include phosphoric acid; sodium salts of phosphoric acid such as sodium dihydrogenphosphate, disodium hydrogenphosphate, trisodium phosphate, sodium pyrophosphate, and sodium metaphosphate; potassium salts of phosphoric acid such as potassium dihydrogenphosphate, dipotassium hydrogenphosphate, tripotassium phosphate, potassium pyrophosphate, and potassium metaphosphate; ammonium salts of phosphoric acid such as ammonium dihydrogenphosphate, diammonium hydrogenphosphate, triammonium phosphate, ammonium pyrophosphate, and ammonium metaphosphate, and so forth, but it is not particularly limited.

<Fibrillation Treatment>

In the fibrillation treatment, the raw material obtained by the aforementioned chemical treatment can be fibrillated by using a fibrillation apparatus to obtain a fine fiber dispersion.

As the fibrillation apparatus, wet milling apparatuses such as grinder (stone mill crusher), high pressure homogenizer, ultra high pressure homogenizer, high pressure impact crusher, ball mill, disk refiner, conical refiner, biaxial kneader, vibration mill, high speed homomixer, ultrasonic disperser, and beater can be used as required, but the fibrillation apparatus is not particularly limited to these.

<Dispersion Containing Fine Fibers>

The dispersion containing fine fibers to be coated to on a base material is a liquid containing fine fibers and a dispersion medium. As the dispersion medium, water or an organic solvent can be used, and water alone is preferred in view of handling and cost, but it is not particularly limited. Even when an organic solvent is used, it is preferably used together with water, but the dispersion medium is not particularly limited. As the organic solvent used together with water, polar solvents, for example, alcohol solvents (methanol, ethanol, propanol, butanol, etc.), ketone solvents (acetone, methyl ethyl ketone, etc.), ether solvents (diethyl ether, ethylene glycol dimethyl ether, tetrahydrofuran, etc.), acetate solvents (ethyl acetate etc.), and so forth are preferred, but it is not particularly limited to these.

Although solid content concentration in the dispersion is not particularly limited, it is preferably 0.1 to 20 mass %, more preferably 0.5 to 10 mass %. If the solid content concentration of the diluted dispersion is not lower than the aforementioned lower limit, efficiency of the fibrillation treatment is improved, and if it is not higher than the aforementioned upper limit, obstruction in the fibrillation apparatus can be prevented.

<Hydrophilic Polymer>

In another aspect of the present invention, a suspension containing a hydrophilic polymer in addition to the fine fibers is prepared.

Examples of the hydrophilic polymer used in the present invention include, for example, polyethylene glycol, cellulose derivatives (hydroxyethylcellulose, carboxyethylcellulose, carboxymethylcellulose, etc.), casein, dextrin, starch, modified starch, polyvinyl alcohol, denatured polyvinyl alcohol (acetoacetylated polyvinyl alcohol etc.), polyethylene oxide, polyvinylpyrrolidone, polyvinyl methyl ether, polyacrylates, polyacrylamide, acrylic acid alkyl ester copolymers, urethane type copolymers, and so forth, but it is not particularly limited. It is particularly preferable to use polyethylene glycol or polyethylene oxide among those mentioned above. It is also possible to use glycerin instead of the hydrophilic polymer.

Although molecular weight of the hydrophilic polymer is not particularly limited, it is, for example, $1.0\times10^3$ to $1.0\times10^7$, preferably $2.0\times10^3$ to $1.0\times10^7$, more preferably $5.0\times10^3$ to $1.0\times10^7$.

Addition amount of the hydrophilic polymer is 1 to 200 mass parts, preferably 1 to 150 mass parts, more preferably 2 to 120 mass parts, particularly preferably 3 to 100 mass parts, with respect to 100 mass parts of solid content of the fine fibers, but it is not particularly limited.

<Suspension Containing Fine Fibers>

The suspension containing fine fibers to be coated on a base material, or the suspension containing the fine fibers and the hydrophilic polymer to be coated on a base material is a liquid containing fine fibers, the hydrophilic polymer, and a dispersion medium. As the dispersion medium, water or an organic solvent can be used, and water alone is preferred in view of handling and cost, but it is not particularly limited. Even when an organic solvent is used, it is preferably used together with water, but the dispersion medium is not particularly limited. As the organic solvent used together with water, polar solvents, for example, alcohol solvents (methanol, ethanol, propanol, butanol, etc.), ketone solvents (acetone, methyl ethyl ketone, etc.), ether solvents (diethyl ether, ethylene glycol dimethyl ether, tetrahydrofuran, etc.), acetate solvents (ethyl acetate etc.), and so forth are preferred, but it is not particularly limited to these.

Although solid content concentration in the dispersion is not particularly limited, it is preferably 0.1 to 20 mass %, more preferably 0.1 to 10 mass %, still more preferably 0.5 to 10 mass %. If the solid content concentration of the diluted dispersion is not lower than the lower limit mentioned above, efficiency of the fibrillation treatment is improved, and if it is not higher than the upper limit mentioned above, obstruction in the fibrillation apparatus can be prevented.

<Coating Step>

The method of the present invention comprises the coating step of coating the dispersion containing fine fibers or the suspension containing fine fibers and the hydrophilic polymer on a base material. As the base material, those in the form of a sheet, of which typical examples are films (including air-permeable films), woven fabrics, and nonwoven fabrics, plates, or cylinders can be used, but it is not particularly limited to these. As the material of the base material, for example, resin, metal, paper, or the like is used, and resin and paper are preferred, since these allow easier production of a sheet containing fine fibers, but the base material is not particularly limited to these. The surface of the base material may be hydrophobic or hydrophilic. Examples of the resin include polytetrafluoroethylene, polyethylene, polypropylene, polyethylene terephthalate, polyvinyl chloride, polyvinylidene chloride, polystyrene, acrylic resin, and so forth, but it is not particularly limited. Examples of the metal include aluminum, stainless steel, zinc, iron, brass, and so forth, but it is not particularly limited.

Examples of the paper base material include, for example, such paper base materials as one-side glazed paper, fine quality paper, wood-containing paper, copy paper, art paper, coated paper, kraft paper, board paper, white lined board paper, news print paper, and woody paper, but it is not particularly limited. At least one surface of the paper base material may be hydrophobized with a hydrophobizing agent. It is preferable to use one-side glazed paper as the paper base material, and hydrophobize the glazed surface thereof, but it is not particularly limited. The one-side glazed paper is obtained by drying a wet paper web obtained after papermaking with a yankee dryer, and one surface thereof is made into a glazed surface showing high gloss. The side of the surface opposite to the glazed surface (rough surface) has a lower density compared with the side of the glazed surface. Therefore, sufficient air permeability can be secured, while high smoothness is provided by the glazed surface, and accordingly, if paper is made with the fine fibers on the hydrophobized glazed surface, a sheet containing fine fibers having a more favorable surface condition can be easily obtained without reducing filtration velocity.

The paper base material is obtained by papermaking with a paper machine or manual papermaking using a paper material containing pulp. The pulp may be wood pulp or nonwood pulp. Examples of raw material of the wood pulp include conifers and broadleaf trees. It is preferred that the pulp contains a large amount of pulp derived from broadleaf trees as the raw material for providing higher smoothness of the paper base material, but it is not particularly limited. The pulp may be mechanical pulp or chemical pulp. The chemical pulp includes kraft pulp (KP, cooking liquor contains NaOH and $Na_2S$), polysulfide pulp (SP, cooking liquor contains NaOH and $Na_2S_X$), soda pulp (cooking liquor contains NaOH), sulfite pulp (cooking liquor contains $Na_2SO_3$), sodium carbonate pulp (cooking liquor contains $Na_2CO_3$), oxygen soda pulp (cooking liquor contains $O_2$ and NaOH), and so forth, and it is not particularly limited. Among these, kraft pulp is preferred in view of smoothness and cost, but it is not particularly limited. The pulp may be unbleached pulp or bleached pulp. The pulp may be unbeaten pulp or beating pulp, and beating pulp is preferred, since it provides improved smoothness of the paper base material, but it is not particularly limited.

Although surface smoothness (Oken smoothness, measured by JAPAN TAPPI paper pulp test method No. 5-2: 2000) of at least one surface of the paper base material to be hydrophobized is not particularly limited, it is preferably 50 seconds or higher, more preferably 150 to 800 seconds. If the surface smoothness of at least one surface of the paper base material to be hydrophobized is not lower than the aforementioned lower limit, a sheet containing fine fibers and having favorable surface conditions can be easily obtained in manufacture of the sheet containing fine fibers to be described later, and if the surface smoothness is not higher than the upper limit, a paper base material that prevents reduction of productivity of the sheet containing fine fibers can be easily obtained.

Although Oken air permeability (JAPAN TAPPI paper pulp test method No. 5-2:2000) of the paper base material is not particularly limited, it is preferably 20 to 500 seconds, more preferably 40 to 300 seconds. If the air permeability of the paper base material is not lower than the aforementioned lower limit, sufficient fine fibers can be trapped, and if it is not higher than the aforementioned upper limit, a paper base material that prevents reduction of productivity of the sheet containing fine fibers can be easily obtained.

Although basis weight of the paper base material is not particularly limited, it is preferably 15 to 300 g/m$^2$, more preferably 20 to 200 g/m$^2$. If the basis weight of the paper base material is not lower than the aforementioned lower limit, a paper base material that can sufficiently trap fine fibers can be more easily obtained, and if the basis weight of the paper base material is not higher than the aforementioned upper limit, a paper base material that prevents reduction of productivity of the sheet containing fine fibers can be more easily obtained.

Although basis weight of the one-side glazed paper as the paper base material is not particularly limited, it is preferably 15 to 300 g/m$^2$, more preferably 20 to 200 g/m$^2$. If the basis weight of the one-side glazed paper is not lower than the aforementioned lower limit, a paper base material that can sufficiently trap fine fibers can be more easily obtained, and if the basis weight of the one-side glazed paper is not higher than the aforementioned upper limit, a paper base material that prevents reduction of productivity of the sheet containing fine fibers can be more easily obtained.

The paper base material can be hydrophobized with a hydrophobizing agent. The hydrophobizing agent is a substance that shows low compatibility with water, and is hardly dissolved in water or mixed with water. The hydrophobizing agent preferably consists of at least one kind selected from the group consisting of a silicone compound, a fluorine compound, polyolefin wax, a higher fatty acid amide, a higher fatty acid alkali salt, and an acrylic polymer, since they can increase mold release property of the paper base material, and it more preferably consists of a silicone compound, since it can provide more favorable mold release property, but it is not particularly limited. The "silicone compound" means a polysiloxane.

As coater for coating the dispersion containing fine fibers, for example, roll coater, engraved-roll coater, die coater, curtain coater, air doctor coater, and so forth can be used, but it is not particularly limited. In view of capability of providing more uniform thickness, die coater, curtain coater, and spray coater are preferred, and die coater is more preferred, but it is not particularly limited to these.

Although coating temperature is not particularly limited, it is preferably 20 to 45° C., more preferably 25 to 40° C., still more preferably 27 to 35° C. If the coating temperature is not lower than the aforementioned lower limit, the dispersion containing fine fibers can be easily coated, and if it is not higher than the aforementioned upper limit, evaporation of the dispersion medium can be suppressed during the coating.

After coating fine fibers, an organic solvent can be added to the sheet containing the fine fibers. The method for adding the organic solvent is not particularly limited, and such a method as dropping method and dipping method can be used.

<Drying Step for Forming Sheet Containing Fine Fibers>

The method of the present invention comprises the drying step of forming a sheet containing fine fibers by drying the dispersion containing fine fibers coated on the base material.

The drying method is not particularly limited, and may be a non-contact drying method, a method of drying a sheet with restraining it, or a combination of these. The drying step preferably comprises at least two stages, more preferably comprises a first non-contact drying step and a subsequent second drying step in which the sheet is dried in a restrained state, but it is not particularly limited to these.

Although the non-contact drying method is not particularly limited, there can be used a method of drying by heating with hot air, infrared ray, far-infrared ray, or near infrared ray (heat drying method), and a method of drying under vacuum (vacuum drying method). Although the heat drying method and the vacuum drying method may be combined, the heat drying method is usually used. The drying with an infrared ray, far-infrared ray, or near infrared ray can be performed by using an infrared radiation apparatus, far-infrared radiation apparatus, or near-infrared radiation apparatus, but it is not particularly limited. Although heating temperature used for the heat drying method is not particularly limited, it is preferably 40 to 120° C., more preferably 60 to 105° C. If the heating temperature is not lower than the aforementioned lower limit, the dispersion medium can be quickly evaporated, and if it is not higher than the upper limit, cost for heating and discoloration of the fine fibers caused by the heating can be suppressed.

Examples of the method of drying a sheet with restraining it include a method of transferring a moisture-containing web so that a surface of the web on which a fine fiber dispersion is coated (henceforth referred to as "coated surface A") contacts with an external surface of a dryer, and a surface of the moisture-containing web not coated with the fine fiber dispersion (henceforth referred to as "non-coated surface B") contacts with felt cloth, as will be explained in this description with reference to FIGS. 1 and 2, and so forth, but it is not particularly limited.

In the embodiment of the method of the present invention comprising a drying step including at least two stages, the solid content concentration ($\rho_2$) of the sheet observed after the first non-contact drying step is not particularly limited, it is preferably 3 to 21 mass %. Further, $\alpha_{21}$ represented by the following equation (1) and calculated from solid content concentration ($\rho_1$) of the sheet observed before the first non-contact drying step, solid content concentration ($\rho_2$) of the sheet observed after the first non-contact drying step, and time $t_{21}$ (minute) required for the solid content concentration to become $\rho_2$ from $\rho_1$ is not particularly limited, but it is preferably 0.01 to 1.0 (%/minute).

$$\alpha_{21}=(\rho_2-\rho_1)/t_{21} \quad \text{Equation (1):}$$

Further, in the embodiment of the method of the present invention comprising a drying step including at least two stages, the solid content concentration ($\rho_4$) of the sheet observed after the drying step is not particularly limited, it is preferably 88 to 99 mass %. Further, $\alpha_{43}$ represented by the following equation (2) and calculated from solid content concentration ($\rho_3$) of the sheet observed before the second drying step where the sheet is dried in a restrained state, solid content concentration ($\rho_a$) of the sheet observed after the second drying step, and time $t_{43}$ (minute) required for the solid content concentration to become $\rho_3$ from $\rho_4$ is not particularly limited, but it is preferably 0.01 to 30.0 (%/minute).

$$\alpha_{43}=(\rho_4-\rho_3)/t_{43} \quad \text{Equation (2):}$$

By controlling the solid content concentration ($\rho_2$), $\alpha_{21}$, solid content concentration ($\rho_4$), and/or $\alpha_{43}$ to be within the aforementioned ranges, a sheet containing fine fibers can be still more easily produced without forming wrinkles.

The method of the present invention comprises the drying step of forming a sheet containing fine fibers by drying a suspension containing the fine fibers and the hydrophilic polymer coated on the base material.

The drying method is not particularly limited, and may be a non-contact drying method, a method of drying a sheet with restraining it, or a combination of these.

In the embodiment of the method of the present invention using the hydrophilic polymer, $\alpha_{21}$ represented by the following equation (1) and calculated from solid content concentration ($\rho_1$) of the sheet observed before the drying step (before the first drying step in the embodiment using the drying step comprising at least two stages), solid content concentration ($\rho_2$) of the sheet observed after the drying step (after the last drying step in the embodiment using the drying step comprising at least two stages), and time $t_{21}$ (minute) required for the solid content concentration to become $\rho_2$ from $\rho_1$ is 0.01 to 30.0 (%/minute), preferably 0.01 to 20.0 (%/minute), more preferably 0.01 to 10.0 (%/minute), particularly preferably 0.01 to 1.0 (%/minute).

$$\alpha_{21}=(\rho_2-\rho_1)/t_{21} \quad \text{Equation (1):}$$

After the drying, the obtained sheet containing fine fibers is separated from the base material. When the base material is a sheet, the laminated sheet containing fine fibers and base material may be rolled up in the laminated state, and the sheet containing fine fibers may be separated from the base material just before use of the sheet containing fine fibers.

The embodiments of the present invention will be explained with reference to the drawings.

As the apparatus for producing a sheet containing fine fibers, there can be used, for example, such a production apparatus as shown in FIG. 1 or 2, which comprises a first drying section 10, a second drying section 20 provided downstream of the first drying section 10, and a rolling-up section 30 provided downstream of the drying sections.

The first drying section 10 is a section for dehydrating and drying dispersion A containing fine fibers (it may contain a hydrophilic polymer) by using a papermaking wire 11 to obtain a moisture-containing web B. In the first drying section 10, there is provided a feeding reel 16 for feeding the papermaking wire 11 so that the hydrophobized smooth surface faces upward, and further provided a suction means 14 for forcibly removing a dispersion medium from the fine fiber dispersion A as desired. The suction means 14 is disposed under the papermaking wire 11, and many suction holes (not shown) connected to a vacuum pump (not shown) are formed on the upper surface thereof. The suction means may not be used.

The second drying section 20 is a section for drying the moisture-containing web B by using a dryer to obtain a sheet C containing fine fibers. In the second drying section 20, there are provided a first dryer 21 constituted by a cylinder dryer (in the apparatus shown FIG. 2, a second dryer 22 is further provided), and felt cloth 24 disposed along the external surface of the first dryer 21. In the apparatus shown in FIG. 2, the first dryer 21 is disposed upstream of the second dryer 22. The felt cloth 24 is made endless, and is circulatorily moved by a guide roll 23.

In the second drying section 20, the moisture-containing web B is transported by the guide roll 23. Specifically, the moisture-containing web B is first transported so that the surface A of the moisture-containing web B on which the fine fiber dispersion A is coated (henceforth referred to as "coated surface A") contacts with the external surface of the first dryer 21, and the surface B of the moisture-containing web B on which the fine fiber dispersion A is not coated (henceforth referred to as "uncoated surface B") contacts with the felt cloth 24. In the apparatus shown in FIG. 2, the coated surface A is subsequently contacted with the external surface of the second dryer 22.

The rolling-up section 30 is a section for separating the sheet C containing fine fibers from the papermaking wire 11, and rolling up the sheet. In the rolling-up section 30, there are provided a pair of separation rollers 31*a* and 31*b* for separating the sheet C containing fine fibers from the papermaking wire 11, a rolling-up reel 32 for rolling up the sheet C containing fine fibers, and a recovery reel 33 for rolling up and recovering the used papermaking wire 11. The separation roller 31*a* is disposed on the side of the papermaking wire 11, and the separation roller 31*b* is disposed on the side of the sheet C containing fine fibers.

(First Drying Step)

In the first drying step, the papermaking wire 11 is fed from the feeding reel 16, and the fine fiber dispersion A is dispensed from a head 18*b* onto the hydrophobized smooth surface of the papermaking wire 11. The dispersion medium contained in the fine fiber dispersion A on the papermaking wire 11 may be dehydrated by suction with the suction means 14. In the first drying step, the fine fiber dispersion is dried with infrared ray radiated from an infrared radiation apparatus 34, and the moisture-containing web B is thereby obtained.

In the first drying step, if tension of the running papermaking wire 11 is high, the papermaking wire 11 may break, and therefore a papermaking wire used for usual papermaking may be disposed under the papermaking wire 11 to support the papermaking wire 11.

In the second drying step, the moisture-containing web B placed on the upper surface of the papermaking wire 11 is first wound around about hemicycle of the external surface of the heated first dryer 21, so that the coated surface A contacts with the external surface of the first dryer 21, to evaporate the dispersion medium remaining in the moisture-containing web B. The evaporated dispersion medium passes through the holes of the papermaking wire 11, and evaporates from the felt cloth 24.

When the apparatus shown in FIG. 2 is used, the moisture-containing web B is subsequently wound around about ¾ cycle of the external surface of the heated second dryer 22, so that the coated surface A contacts with the external surface of the second dryer 22, to evaporate the dispersion medium remaining in the moisture-containing web B.

The moisture-containing web B is dried as described above to obtain the sheet C containing fine fibers.

In the rolling-up step, by putting the papermaking wire 11 and the sheet C containing fine fibers between a pair of separation rollers 31*a* and 31*b*, the sheet C containing fine fibers is separated from the papermaking wire 11, and transferred to the surface of one of the rollers, i.e., the separation roller 31*b*. Then, the sheet C containing fine fibers is pulled apart from the surface of the separation roller 31*b*, and rolled up with the rolling-up reel 32. At the same time, the papermaking wire 11 used is rolled up with the recovery reel 33.

A sheet containing fine fibers can be obtained by using the papermaking wire 11 as described above.

The present invention will be explained in more detail with reference to the following examples. However, the present invention is not limited by these examples.

EXAMPLES

Example 1

Fine Cellulose Fiber Dispersion A

Sodium dihydrogenphosphate dihydrate (265 g) and disodium hydrogenphosphate (197 g) were dissolved in water (538 g) to obtain an aqueous solution of the phosphoric acid compounds (henceforth referred to as "phosphorylation reagent").

Needle bleached kraft pulp (water content, 50 mass %; Canadian Standard Freeness (CSF) measured according to JIS P8121, 700 ml; Oji Paper) was diluted with ion exchange water so that water content of the pulp became 80 mass % to obtain pulp slurry. The phosphorylation reagent (210 g) was added to the pulp slurry (500 g), and the mixture was dried with an air blow dryer (DKM400, Yamato Science) at 105° C. with occasional stirring until constant mass was obtained. Then, the pulp was heated with an air blowing dryer at 150° C. for 1 hour with occasional stirring to introduce phosphoric acid groups into cellulose.

Then, ion exchange water (5000 ml) was added to the phosphoric acid group-introduced cellulose, and the pulp suspension was washed by stirring, and dehydrated. The dehydrated pulp was diluted with ion exchange water (5000 ml), and 1 N aqueous sodium hydroxide was added little by little until pH of the pulp became 12 to 13 to obtain pulp slurry. Then, this pulp slurry was dehydrated, and washed with ion exchange water (5000 ml). This dehydration and washing process was repeated once more.

Ion exchange water was added to the pulp obtained after the washing and dehydration to obtain 1.0 mass % pulp slurry. This pulp slurry was passed through high pressure homogenizer ("Panda Plus 2000", NiroSoavi) 10 times at an operating pressure of 1200 bar to obtain fine cellulose fiber dispersion A. The average fiber width (fiber diameter) of the fine cellulose fibers was 4.2 nm.

(Papermaking Wire A)

Paper was made from a paper material consisting of leaf breached haft pulp obtained by beating (100 weight parts; Canadian Standard Freeness (henceforth abbreviated as CSF) measured according to JIS P8121, 350 ml), sizing agent (0.05 mass part; trade name, Fiverun 81K; Japan NSC), aluminum sulfate (0.45 mass part), cationized starch (0.5 mass part), polyamide/epichlorohydrin resin (paper-strengthening agent, 0.4 mass part), and a small quantity of yield-improving agent using a fourdrinier paper machine. The obtained wet paper web was dried, and then subjected to calendering (linear pressure, 100 kg/cm) to obtain one-side glazed paper showing glazed surface smoothness of 575 seconds, rough surface smoothness of 7 seconds, air permeability of 130 second, paper moisture content of 5.5%, and basis weight of 100 g/m$^2$. The glazed surface of the obtained one-side glazed paper was coated with a coating material obtained by adding silicone type hydrophobizing agent KS3600 (100 parts, Shin-Etsu Chemical), and curing agent PL50T (1 part, Shin-Etsu Chemical) to a mixed solvent consisting of toluene and ethyl acetate (3/1) at a concentration of 3 mass % and stirring the mixture at a coating amount of 2 g/m$^2$ using a bar coater, and the coating material was dried at 100° C. to obtain a papermaking wire A having a hydrophobized glazed surface. The surface smoothness of the glazed surface of the papermaking wire A was 650 seconds.

Experimental Example 1

A continuous sheet containing fine cellulose fibers was produced by using the production apparatus shown in FIG. 1. As the papermaking wire 11, the papermaking wire A was used.

That is, the aforementioned fine cellulose fiber dispersion A was put into a supply tank 13, and supplied to a die head 18*b* with stirring by a stirrer 13*a*. Then, the fine cellulose fiber dispersion A was supplied onto the upper surface of the running papermaking wire 11 from a hole 18*a* of the die coater 18, and water in the fine cellulose fibers dispersion was evaporated with an infrared radiation apparatus 34 to obtain a moisture-containing web B.

Then, the moisture-containing web B was transferred to the drying section 20, and dried with the first dryer 21 (set temperature, 80° C.) to obtain a sheet C containing fine cellulose fibers.

Then, the papermaking wire 11 and the sheet C containing fine cellulose fibers were delaminated (separated) with the separation rollers 31*a* and 31*b*, the sheet C containing fine cellulose fibers was rolled up with the rolling-up reel 32, and the papermaking wire 11 was rolled up with the recovery reel 33. Wrinkles of the obtained sheet C containing fine cellulose fibers and sheet production were evaluated by the following methods. The results are shown in Table 1.

In this example, the solid content concentration ($\rho_1$) of the sheet observed before the first non-contact drying step is the solid content concentration of the sheet observed just before the sheet was irradiated with infrared ray by the infrared radiation apparatus 34 shown in FIG. 1, and the solid content concentration ($\rho_2$) of the sheet observed after the first non-contact drying step is the solid content concentration of the sheet observed immediately after the sheet was irradiated with infrared ray by the infrared radiation apparatus 34 shown in FIG. 1. The solid content concentration ($\rho_3$) of the sheet observed before the second drying step is the solid content concentration of the sheet observed just before the sheet was transferred to the first dryer 21 of FIG. 1, and the solid content concentration ($\rho_a$) of the sheet observed after the second drying step is the solid content concentration of the sheet observed immediately after the sheet exited the first dryer 21 shown in FIG. 1.

<Evaluation of Wrinkles>

Degree of wrinkles of the sheet containing fine cellulose fibers was evaluated according to the following evaluation criteria.

O: Wrinkles are not observed.

Δ: A few wrinkles are observed.

x: Wrinkles are clearly observed.

TABLE 1

| Experiment No. | Solid content concentration of raw material $\rho_0$ (%) | Type of first non-contact drying step | Solid content concentration after non-contact drying step $\rho_2$ (%) | Drying rate $\alpha_{21}$ (%/minute) | Solid content concentration after second drying step $\rho^4$ (%) | Drying rate $\alpha_{43}$ (%/minute) | Evaluation of wrinkles |
|---|---|---|---|---|---|---|---|
| 1 | 0.5 | Far-infrared drying | 0.9 | 0.10 | 93.1 | 23.05 | Δ |
| 2 | 0.5 | Far-infrared drying | 3.0 | 0.25 | 93.3 | 9.03 | ○ |
| 3 | 0.5 | Far-infrared drying | 6.0 | 0.27 | 93.2 | 4.36 | ○ |
| 4 | 0.5 | Far-infrared drying | 10.2 | 0.21 | 93.0 | 1.86 | ○ |
| 5 | 0.5 | Far-infrared drying | 19.9 | 0.21 | 92.9 | 0.80 | ○ |
| 6 | 0.5 | Far-infrared drying | 25.3 | 0.19 | 92.7 | 0.54 | Δ |
| 7 | 1.0 | Far-infrared drying | 1.2 | 0.20 | 93.5 | 9.23 | Δ |
| 8 | 1.0 | Far-infrared drying | 3.7 | 0.27 | 93.3 | 8.96 | ○ |
| 9 | 1.0 | Far-infrared drying | 6.9 | 0.29 | 93.0 | 4.31 | ○ |
| 10 | 1.0 | Far-infrared drying | 10.1 | 0.20 | 92.7 | 1.86 | ○ |
| 11 | 1.0 | Far-infrared drying | 20.0 | 0.21 | 93.1 | 0.80 | ○ |
| 12 | 1.0 | Far-infrared drying | 25.1 | 0.19 | 93.2 | 0.54 | Δ |
| 13 | 2.0 | Far-infrared drying | 3.1 | 0.22 | 93.1 | 18.00 | ○ |
| 14 | 2.0 | Far-infrared drying | 5.9 | 0.19 | 93.2 | 4.37 | ○ |
| 15 | 2.0 | Far-infrared drying | 9.9 | 0.19 | 93.1 | 2.08 | ○ |
| 16 | 2.0 | Far-infrared drying | 20.1 | 0.22 | 93.0 | 0.91 | ○ |
| 17 | 2.0 | Far-infrared drying | 24.9 | 0.18 | 93.4 | 0.55 | Δ |
| 18 | 3.0 | Far-infrared drying | 3.1 | 0.02 | 93.1 | 27.00 | ○ |
| 19 | 3.0 | Far-infrared drying | 6.1 | 0.15 | 93.2 | 4.36 | ○ |
| 20 | 3.0 | Far-infrared drying | 10.1 | 0.17 | 93.1 | 2.08 | ○ |
| 21 | 3.0 | Far-infrared drying | 20.1 | 0.21 | 93.0 | 0.91 | ○ |
| 22 | 3.0 | Far-infrared drying | 24.9 | 0.17 | 93.4 | 0.55 | Δ |
| 23 | 1.0 | Hot air drying | 3.2 | 0.22 | 93.3 | 9.01 | Δ |
| 24 | 1.0 | Hot air drying | 5.5 | 0.22 | 93.2 | 4.39 | Δ |
| 25 | 1.0 | Hot air drying | 10.4 | 0.46 | 93.0 | 4.13 | Δ |
| 26 | 1.0 | Hot air drying | 19.5 | 0.41 | 92.7 | 1.65 | Δ |
| 27 | 1.0 | Hot air drying | 25.1 | 0.19 | 93.2 | 0.54 | Δ |

Examples 2 to 9

Fine Cellulose Fiber Dispersion A

Sodium dihydrogenphosphate dihydrate (265 g) and disodium hydrogenphosphate (197 g) were dissolved in water (538 g) to obtain an aqueous solution of the phosphoric acid compounds (henceforth referred to as "phosphorylation reagent").

Needle bleached kraft pulp (water content, 50%; Canadian Standard Freeness (CSF) measured according to JIS P8121, 700 ml; Oji Paper) was diluted with ion exchange water so that water content of the pulp became 80 mass % to obtain pulp suspension. The phosphorylation reagent (210 g) was added to the pulp suspension (500 g), and the mixture was dried with an air blow dryer (DKM400, Yamato Science) at 105° C. with occasional stirring until constant mass was obtained. Then, the suspension was heated with an air blowing dryer at 150° C. for 1 hour with occasional stirring to introduce phosphoric acid groups into cellulose.

Then, ion exchange water (5000 ml) was added to the phosphoric acid group-introduced cellulose, and the pulp suspension was washed by stirring, and then dehydrated. The dehydrated pulp was diluted with ion exchange water (5000 ml), and 1 N aqueous sodium hydroxide was added little by little until pH of the pulp became 12 to 13 to obtain pulp suspension. Then, this pulp suspension was dehydrated, and washed with ion exchange water (5000 ml). This dehydration and washing process was repeated once more.

Ion exchange water was added to the pulp obtained after the washing and dehydration to obtain 1.0 mass % pulp suspension. This pulp suspension was passed through high pressure homogenizer ("Panda Plus 2000", NiroSoavi) 5 times at an operating pressure of 1200 bar to obtain fine cellulose fiber dispersion A. The suspension was further passed through a wet atomizing apparatus (Ultimizer, Sugino Corp.) 5 times at a pressure of 245 MPa to obtain fine cellulose fiber suspension B. The average fiber width of the fine cellulose fibers was 4.2 nm.

Example 2

Polyethylene glycol (molecular weight, 20000; Wako Pure Chemical Industries) as the hydrophilic polymer was added to the fine cellulose fiber suspension B so that polyethylene glycol was added in an amount of 50 mass parts with respect to 100 mass parts of fine cellulose fibers. Concentration of the suspension was adjusted so that solid content concentration thereof became 0.5%. The suspension was measured in such a volume that a sheet basis weight of 35 $g/m_2$ should be obtained, spread on a commercial acrylic resin plate, and dried in an oven at 50° C. to obtain a sheet containing fine cellulose fibers. A plate for damming up the suspension was disposed on the acrylic resin plate so that a rectangular sheet having the predetermined basis weight was obtained. The obtained sheet showed no wrinkle, and was even.

Example 3

A sheet containing fine cellulose fibers was obtained in the same manner as that of Example 2 except that polyethylene glycol was added in an amount of 30 mass parts. The obtained sheet had a few wrinkles at the end portions, but it was a generally even sheet.

Example 4

A sheet containing fine cellulose fibers was obtained in the same manner as that of Example 2 except that polyeth ylene glycol was added in an amount of 100 mass parts. The obtained sheet had no wrinkle, and it was even.

Example 5

A sheet containing fine cellulose fibers was obtained in the same manner as that of Example 2 except that polyethylene glycol (molecular weight, 500000; Wako Pure Chemical Industries) was used as the hydrophilic polymer. The obtained sheet had no wrinkle, and it was even.

Example 6

A sheet containing fine cellulose fibers was obtained in the same manner as that of Example 2 except that polyethylene glycol (molecular weight, 2000000; Wako Pure Chemical Industries) was used in an amount of 10 mass parts as the hydrophilic polymer. The obtained sheet had no wrinkle, and it was even.

Chemical Industries) was used in an amount of 20 mass parts as the hydrophilic polymer. The obtained sheet had no wrinkle, and it was even.

Comparative Example 1

A sheet containing fine cellulose fibers was produced in the same manner as that of Example 2 except that no polyethylene glycol was added. The obtained sheet had a lot of wrinkles, and significantly wound.

For the sheets of Examples 2 to 9 and Comparative Example 1, $\alpha_{21}$ represented by the following equation (1) and calculated from the solid content concentration ($\rho_1$) of the sheet observed before the drying step, solid content concentration ($\rho_2$) of the sheet observed after the drying step, and time $t_{21}$ (minute) required for the solid content concentration to become $\rho_2$ from $\rho_1$ was obtained.

$$\alpha_{21}=(\rho_2-\rho_1)/t_{21} \quad \text{Equation (1):}$$

The results for the sheets of Examples 2 to 9 and Comparative Example 1 are shown in Table 2 mentioned below.

TABLE 2

| | Example 2 | Example 3 | Example 4 | Example 5 | Example 6 | Example 7 | Example 8 | Example 9 | Comparative Example 1 |
|---|---|---|---|---|---|---|---|---|---|
| Hydrophilic polymer | PEG | PEG | PEG | PEG | PEG | PEG | PEG | PEG | Not added |
| Molecular weight | 20,000 | 20,000 | 20,000 | 500,000 | 2,000,000 | 4,000,000 | 4,000,000 | 4,000,000 | — |
| Amount | 50 | 30 | 100 | 30 | 10 | 5 | 10 | 20 | — |
| Wrinkles | ○ | ○ | ○ | ○ | ○ | ○ | ○ | ○ | x |
| $\alpha_{21}$ (%/minute) | 0.064 | 0.067 | 0.062 | 0.069 | 0.063 | 0.070 | 0.065 | 0.069 | 0.073 |

The amount is number of mass parts with respect to 100 mass parts of solid content of fine cellulose fiber.
○: The obtained sheet had no wrinkle, and was even.
x: The obtained sheet had many wrinkles, and significantly wound.

Example 7

A sheet containing fine cellulose fibers was obtained in the same manner as that of Example 2 except that polyethylene glycol (molecular weight, 4000000; Wako Pure Chemical Industries) was used in an amount of 5 mass parts as the hydrophilic polymer. The obtained sheet had no wrinkle, and it was even.

Example 8

A sheet containing fine cellulose fibers was obtained in the same manner as that of Example 2 except that polyethylene glycol (molecular weight, 4000000; Wako Pure Chemical Industries) was used in an amount of 10 mass parts as the hydrophilic polymer. The obtained sheet had no wrinkle, and it was even.

Example 9

A sheet containing fine cellulose fibers was obtained in the same manner as that of Example 2 except that polyethylene glycol (molecular weight, 4000000; Wako Pure

The invention claimed is:

1. A method for producing a sheet containing fine fibers, which comprises preparing a dispersion by treating a cellulose raw material with at least one compound selected from oxo acid, polyoxo acid, and salt thereof containing a phosphorus atom in the structure thereof and subjecting the resultant material to a fibrillation treatment to produce the dispersion containing cellulose fine fibers;

adding to the dispersion containing the cellulose fine fibers a hydrophilic polymer;

a coating step of coating the dispersion containing cellulose fine fibers having a fiber diameter of 1000 nm or smaller and the hydrophilic polymer on a base material;

a drying step of drying the dispersion containing cellulose fine fibers coated on the base material to form a sheet containing cellulose fine fibers; and a step of separating the obtained sheet from the base material, wherein the hydrophilic polymer is polyethylene glycol, hydroxyethylcellulose, carboxyethylcellulose, carboxymethylcellulose, casein, dextrin, starch, modified starch, polyvinyl alcohol, denatured polyvinyl alcohol, polyethylene oxide, polyvinylpyrrolidone, polyvinyl methyl ether, polyacrylate, polyacrylamide, acrylic acid alkyl ester copolymer, or urethane type copolymer, wherein 5 to 100 mass parts of the hydrophilic polymer is added with respect to 100 mass parts of solid content of the cellulose fine fibers.

2. The method for producing a sheet containing fine fibers according to claim 1, wherein the drying step includes at least two stages.

3. The method for producing a sheet containing fine fibers according to claim 1, wherein the drying step includes a first non-contact drying step and a subsequent second drying step in which the sheet is dried in a restrained state.

4. The method for producing a sheet containing fine fibers according to claim 3, wherein the first non-contact drying step is performed by using one or more selected from an infrared radiation apparatus, a far-infrared radiation apparatus, and a near-infrared radiation apparatus.

5. The method for producing a sheet containing fine fibers according to claim 3, wherein, after the first non-contact drying step, the sheet has a solid content concentration ($\rho_2$) of 3 to 21 mass %.

6. The method for producing a sheet containing fine fibers according to claim 3, wherein $\alpha_{21}$ represented by the following equation (1) and calculated from solid content concentration ($\rho_1$) of the sheet observed before the first non-contact drying step, solid content concentration ($\rho_2$) of the sheet observed after the first non-contact drying step, and time $t_{21}$ (minute) required for the solid content concentration to become $\rho_2$ from $\rho_1$ is 0.01 to 1.0 (%/minute), $$\alpha_{21}=(\rho_2-\rho_1)/t_{21}. \quad \text{Equation (1):}$$

7. The method for producing a sheet containing fine fibers according to claim 3, wherein $\alpha_{43}$ represented by the following equation (2) and calculated from solid content concentration ($\rho_3$) of the sheet observed before the second drying step where the sheet is dried in a restrained state, solid content concentration (pa) of the sheet observed after the second drying step, and time $t_{43}$ (minute) required for the solid content concentration to become $\rho_3$ from $\rho_4$ is 0.01 to 30.0 (%/minute), $$\alpha_{43}=(\rho_4-\rho_3)/t_{43}. \quad \text{Equation (2):}$$

8. The method for producing a sheet containing fine fibers according to claim 1, wherein the solid content concentration (pa) of the sheet observed after the drying step is 88 to 99 mass %.

9. The method for producing a sheet containing fine fibers according to claim 1, which comprises the step of filtering the dispersion containing cellulose fine fibers with a papermaking wire, which is performed before or during the drying step of drying the dispersion containing cellulose fine fibers coated on the base material to form the sheet containing cellulose fine fibers.

10. The method for producing a sheet containing fine fibers according to claim 1, wherein the sheet containing cellulose fine fibers is a continuous sheet.

11. A method for producing a sheet containing fine fibers, which comprises preparing a suspension by treating a cellulose raw material with at least one compound selected from oxo acid, polyoxo acid, and salt thereof containing a phosphorus atom in the structure thereof and subjecting the resultant material to a fibrillation treatment to produce the suspension containing cellulose fine fibers;

adding to the suspension containing the cellulose fine fibers a hydrophilic polymer;

a coating step of coating the suspension on a base material;

drying the suspension to form a sheet containing cellulose fine fibers, wherein the suspension contains cellulose fine fibers which is obtained by subjecting a fiber raw material to a chemical treatment and a fibrillation treatment and has an average fiber width of 2 to 100 nm, and the hydrophilic polymer; and a step of separating the obtained sheet from the base material, wherein the hydrophilic polymer is polyethylene glycol, hydroxyethylcellulose, carboxyethylcellulose, carboxymethylcellulose, casein, dextrin, starch, modified starch, polyvinyl alcohol, denatured polyvinyl alcohol, polyethylene oxide, polyvinylpyrrolidone, polyvinyl methyl ether, polyacrylate, polyacrylamide, acrylic acid alkyl ester copolymer, or urethane type copolymer, wherein 5 to 100 mass parts of the hydrophilic polymer is added with respect to 100 mass parts of solid content of the cellulose fine fibers.

12. The method for producing a sheet containing fine fibers according to claim 11, wherein the hydrophilic polymer has a number average molecular weight of $1.0\times10^3$ to $1.0\times10^7$.

* * * * *